US005747716A

United States Patent [19]

Matsumoto

[11] Patent Number: 5,747,716

[45] Date of Patent: May 5, 1998

[54] MEDLEY PLAYBACK APPARATUS WITH ADAPTIVE EDITING OF BRIDGE PART

[75] Inventor: Shuichi Matsumoto, Hamamatsu, Japan

[73] Assignee: Yamaha Corporation, Hamamatsu, Japan

[21] Appl. No.: 787,442

[22] Filed: Jan. 22, 1997

[30] Foreign Application Priority Data

Jan. 23, 1996 [JP] Japan ..... 8-009591

[51] Int. Cl.[6] ..... G10H 1/26; G10H 1/42

[52] U.S. Cl. ..... 84/609; 84/612; 84/636; 84/DIG. 12

[58] Field of Search ..... 84/609–614, 634–638, 84/DIG. 12

[56] References Cited

U.S. PATENT DOCUMENTS 5,454,723 10/1995 Horii .
5,608,178 3/1997 Iwase ..... 84/609

FOREIGN PATENT DOCUMENTS 283591 3/1990 Japan .

*Primary Examiner*—Stanley J. Witkowski
*Attorney, Agent, or Firm*—Pillsbury Madison & Sutro LLP

[57] ABSTRACT

In a medley playback apparatus, a storage device stores a plurality of performance data corresponding to a plurality of music pieces. A generator device is fed with the performance data to generate musical tones to thereby play back the corresponding music piece. A designator device designates at least a first music piece and a second music piece among the plurality of the music pieces. An editor device mutilates first performance data corresponding to the first music piece so as to produce a preceding compact part thereof, also mutilates second performance data corresponding to the second music piece so as to produce a succeeding compact part thereof, and creates intermediate performance data based on the first performance data and the second performance data so as to produce a bridge part connecting between the preceding compact part and the succeeding compact part. A sequencer device sequentially feeds the generator device with the mutilated first performance data, the intermediate performance data and the mutilated second performance data to thereby play back a desired medley composed of a sequence of the preceding compact part, the bridge part and the succeeding compact part.

16 Claims, 5 Drawing Sheets

MEDLEY PLAYBACK APPARATUS WITH ADAPTIVE EDITING OF BRIDGE PART

BACKGROUND OF THE INVENTION

1. Field of the Invention

The present invention relates to a medley playback apparatus for playing back music pieces in a medley.

2. Description of the Related Art

In conventional karaoke apparatuses, when a desired music piece is specified, corresponding karaoke play data are read from a storage device and the specified music piece is reproduced. At the same time, lyrics are displayed based on the read karaoke play data. A karaoke singer sings the specified music piece while following the lyrics being displayed.

Generally, the conventional karaoke apparatus provides a capability of reserving entry of a plurality of music pieces. When the reservation is made, the reserved music pieces are sequentially played back in the order of entry.

Meanwhile, a singer who has a large repertoire of favorite songs may desire to sing a variety of songs in a relatively short time. To meet such a requirement, karaoke apparatuses have been developed that hasten a tempo of the reproduced music up to an extent at which the music yet sounds natural, or that fade out a currently played musical piece at the end of a second chorus part thereof to switch to a next music piece. Also, for karaoke music, a medley piece is known in which a plurality of music pieces are connected to each other such that chorus parts thereof are arranged sequentially.

However, there is a limitation with respect to the tempo at which the player can comfortably sing. Therefore, hastening the tempo of music to an extent at which the music yet sounds natural cannot significantly increase the number of music pieces per unit time. In the conventional karaoke apparatus in which the currently played musical piece is faded out from the end of a second chorus thereof to be followed by a next music piece, an interval between the current and next music pieces loses a sense of consistency therebetween, causing the karaoke singer to somewhat lose interest in continuing the singing. On the other hand, the medley playback has no such a defect, and the sense of consistency is maintained between the musical pieces in the medley piece. However, the medley music is ready-made and therefore may contain numbers with which the karaoke singer is not familiar.

SUMMARY OF THE INVENTION

It is therefore an object of the present invention to provide a medley playback apparatus for generating a medley composed of a plurality of music pieces in a karaoke machine.

The inventive medley playback apparatus comprises a storage device that stores a plurality of performance data corresponding to a plurality of music pieces, a generator device that is fed with the performance data to generate musical tones to thereby play back the corresponding music piece, a designator device that designates at least a first music piece and a second music piece among the plurality of the stored music pieces, an editor device that mutilates first performance data corresponding to the first music piece so as to produce a preceding compact part thereof, that also mutilates second performance data corresponding to the second music piece so as to produce a succeeding compact part thereof, and that creates intermediate performance data based on the first performance data and the second performance data so as to produce a bridge part connecting between the preceding compact part and the succeeding compact part, and a sequencer device that sequentially feeds the generator device with the mutilated first performance data, the intermediate performance data and the mutilated second performance data to thereby play back a desired medley composed of a sequence of the preceding compact part, the bridge part and the succeeding compact part.

In a preferred form, the generator device comprises a pair of tone generators which can generate musical tones independently from each other. The sequencer device feeds the mutilated first performance data to one of the tone generators and feeds the mutilated second performance data to the other of the tone generators while feeding the intermediate performance data to either of the tone generators.

In a specific form, the editor device produces the bridge part according to a musical property of the first music piece and the second music piece. The musical property includes at least one of a tempo, a tonality, a meter and a genre such that the bridge part fits for musically connecting the first compact part to the second compact part. Preferably, the editor device produces the fitting bridge part having a transitional tempo effective to adjust a difference of the tempo between the first compact part and the second compact part. Further, the editor device produces the fitting bridge part having a transitional tonality effective to adjust a difference of the tonality between the first compact part and the second compact part. Moreover, the editor device examines the first performance data and the second performance data to extract therefrom the musical property of the first music piece and the second music piece.

In a specific form, the editor device divides the first performance data at a preceding break point to mutilate the first performance data and divides the second performance data at a succeeding break point to mutilate the second performance data. The sequencer device retrieves the mutilated first performance data before the preceding break point from the storage device to feed the generator device, then feeds the generator device with the intermediate performance data, and thereafter retrieves the mutilated second performance data after the succeeding break point from the storage device to feed the generator device. In such a case, the editor device analyzes the first performance data to set the preceding break point effective to separate the first compact part from an ending part of the first music piece, and analyzes the second performance data to set the succeeding break point effective to separate the second compact part from an introductory part of the second music piece.

DETAILED DESCRIPTION OF PREFERRED EMBODIMENTS

Figure 1:
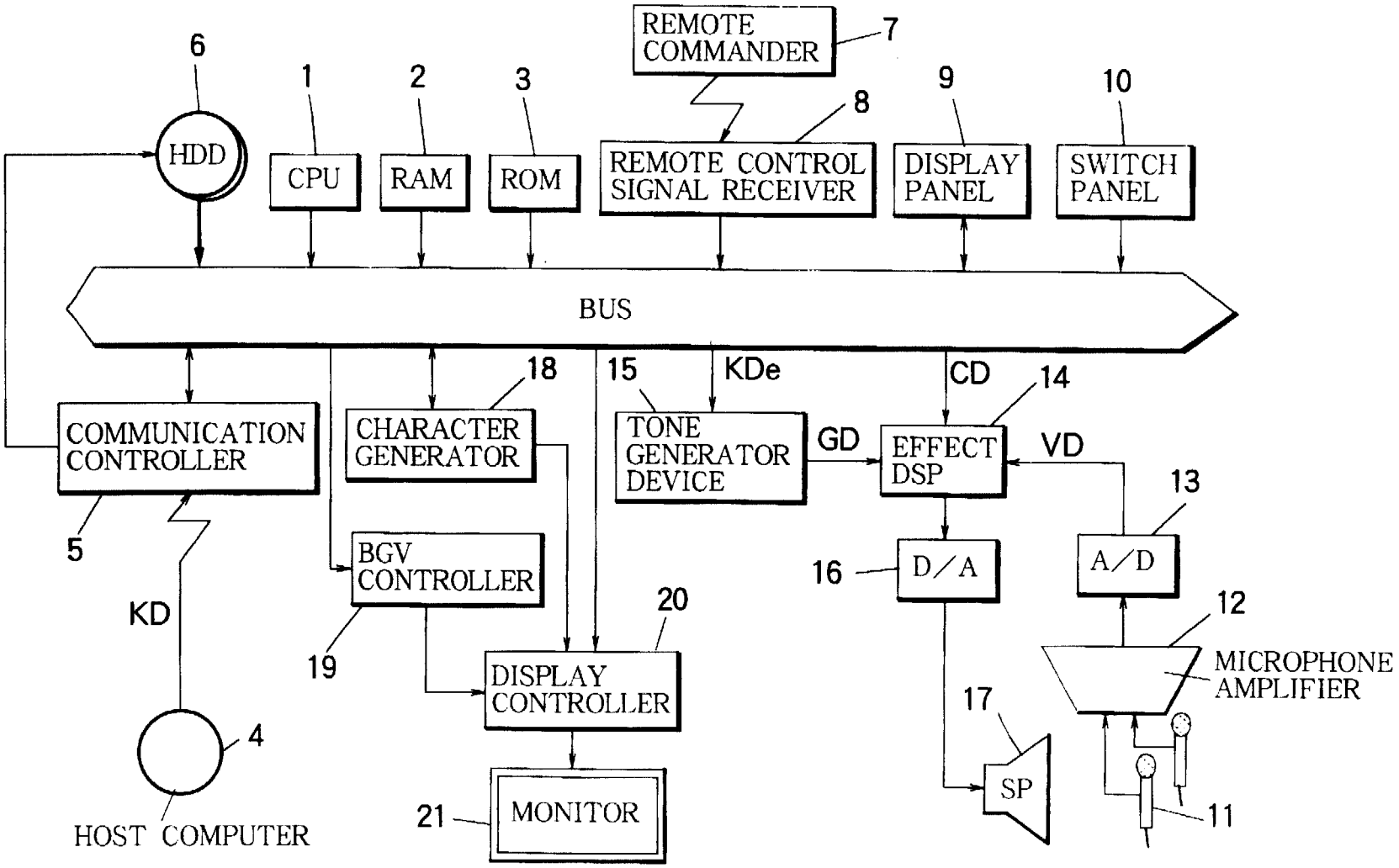
FIG. 1 is a block diagram illustrating a karaoke apparatus practiced as a preferred embodiment of the present invention.

This invention will be described in further detail by way of example with reference to the accompanying drawings. A constitution of one preferred embodiment of the present invention will be described with reference to drawings. FIG. 1 is a block diagram illustrating a karaoke apparatus practiced as one preferred embodiment of the invention.

Now, referring FIG. 1, reference numeral 1 denotes a CPU (Central Processing Unit) for controlling other components of the embodiment, which are interconnected via a bus. Reference numeral 2 denotes a RAM (Random Access Memory) that functions as a work area of the CPU 1 and that temporarily stores a variety of data. Reference numeral 3 denotes a ROM (Read Only Memory) that stores a program executed for controlling the karaoke apparatus in its entirety and a variety of font information used for displaying lyrics of a karaoke song.

Reference numeral 4 denotes a host computer connected to the karaoke apparatus via a communication line to distribute karaoke music data KD representative of a number of music pieces. The karaoke music data KD are composed of performance data KDe, lyrics data KDk, and image data KDg. The performance data or play data KDe represent a music piece to be used for karaoke playing, and are composed of a plurality of data strings called tracks that correspond to multiple parts of the music such as base, melody, harmony, and rhythm. The lyrics data KDk indicate the lyrics to be displayed in synchronization with the reproduction of the music, and control color change in the lyrics characters. The image data KDg indicate a type of background picture. Reference numeral 5 denotes a communication controller composed of a modem and other necessary components to control data communication between the karaoke apparatus and the host computer 4. Reference numeral 6 denotes a hard disk drive (HDD) connected as a storage device to the communication controller 5 to store the music data KD distributed from the host computer 4.

Figure 2:
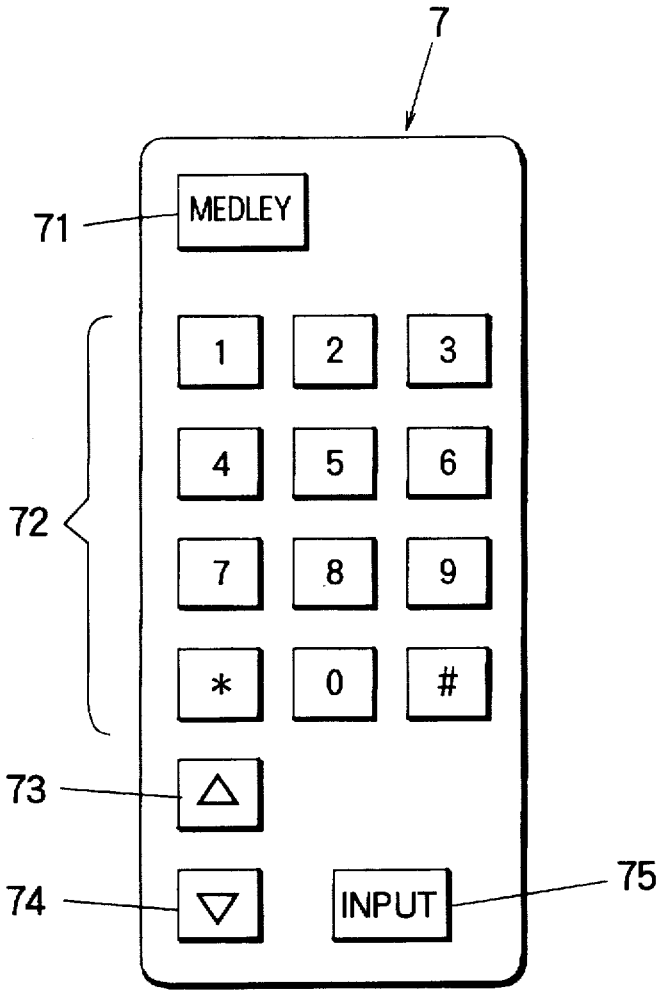
FIG. 2 is a plan view of a remote commander for use in the embodiment of FIG. 1.

Reference numeral 7 denotes a remote commander. Input operations performed on the same are transmitted to the karaoke apparatus via infrared radiation by way of example. To be specific, when a user enters a music code, a key, a tempo and other information into the remote commander 7, the same detects these operations to generate a detection signal, which is transmitted to other components of the karaoke apparatus. Referring to FIG. 2, there is shown a plan view of the remote commander 7. In the figure, reference numeral 72 denotes a numeric key section, through which a desired music code is input for reservation. Upon pressing an input button 75 after operating the numeric key section 72, the entered music code is confirmed. Reference numeral 71 is a medley input button, which is pressed to play back a medley. Reference numerals 73 and 74 denote key input buttons. Pressing the key input button 73 stepwise sharpens the tone of the music. Pressing the key input button 74 stepwise flattens the tone of the music. Key input can be made not only at reservation of music pieces to be sung but also made during playing, thereby allowing a karaoke singer to adjust the key to a level at which he or she is more comfortable to sing.

Referring to FIG. 1 again, reference numeral 8 denotes a remote control signal receiver for receiving the detection signal fed from the remote commander 7 and for transferring the received signal to the CPU 1. Reference numeral 9 denotes a display panel disposed on the front side of the karaoke apparatus, on which information such as the selected music codes is displayed. Reference numeral 10 denotes a switch panel disposed on the same surface on which the display panel 9 is disposed. The switch panel 10 provides generally the same functions as those of the remote commander 7. Reference numeral 11 denotes a microphone through which a singing voice is collected and converted to an electrical voice signal.

Reference numeral 15 denotes a generator device composed of a plurality of tone generators. The tone generator device 15 is controlled by the play data KDe contained in the karaoke music data KD, such that each tone generator generates music sound data GD based on one piece of the play data. The play data KDe are composed of note event data for indicating tone generation and setting data for indicating setting of each tone generator. Each tone generator has a plurality of channels, each of which is selected by the setting data. The setting data also specify timbre and pitch of each tone or note to be generated. The note event data indicate tone generation timing and the like.

The voice signal fed from the microphone 11 is amplified by a microphone amplifier 12. The amplified voice signal is converted to a digital signal by an A/D converter 13, and is then fed to an effect DSP 14 as voice data VD. The effect DSP 14 is controlled by control data CD generated by the CPU 1 to provide an echo effect, for example, to the voice data VD and the music sound data GD, and performs pitch conversion on the music sound data GD based on a key input operation by the remote commander 7. Data output from the effect DSP 14 are converted by a D/A converter 16 to an analog signal, which is amplified by an amplifier (not shown) and fed to a speaker (SP) 17 for acoustic sounding of the karaoke music and the singing voice.

Reference numeral 18 denotes a character generator that, under control of the CPU 1, reads the font information stored in the ROM 3 in accordance with the lyrics data KDk read from the hard disk 6, and changes colors of the lyrics characters to be displayed in synchronization with progression of the karaoke music. Reference numeral 19 denotes a BGV controller having an internal image record media such as a laser disc. The BGV controller 19 reads image information corresponding to the image data KDg from the image record media to transfer the read image information to a display controller 20. The display controller 20 integrates the image information fed from the BGV controller 19 with the font information fed from the character generator 18 to display the integrated result on a monitor 21.

The following describes operations of the above-mentioned preferred embodiment of the invention with reference to the drawings. In the following description, as an example, two pieces of music are formed into a medley.

Figure 3:
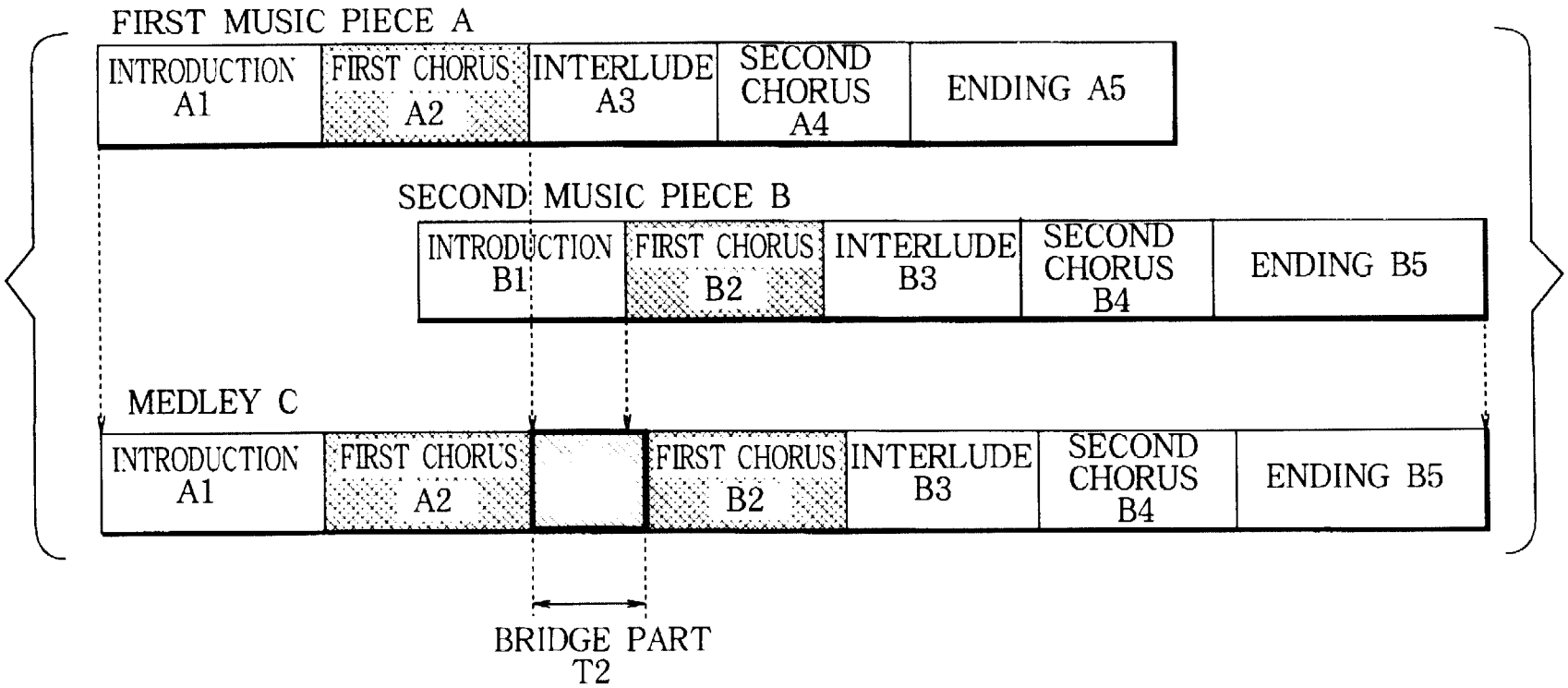
FIG. 3 is a diagram showing a constitution of a medley produced by the embodiment of FIG. 1.

First, referring to FIG. 3, there is shown a relationship between a first musical piece A, a second musical piece B immediately following the first musical piece A, and a medley C composed of these first and second pieces of music. The first musical piece A is composed of serial parts including an introduction A1, a first chorus A2, an interlude A3, a second chorus A4, and an ending A5. The second musical piece B is composed of serial parts including an introduction B1, a first chorus B2, an interlude B3, a second chorus B4, and an ending B5. In the medley C formed from these first and second pieces of music A and B, a preceding part composed of the introduction A and the first chorus A2 is played followed by a bridge part T2 which in turn is followed by a succeeding part composed of the first chorus B2 of the musical piece B, the interlude B3, the second chorus B4, and the ending B5 in this order. Because the interlude A3, the second chorus A4, and the ending A5 of the musical piece A are omitted from the medley C, the total play time is shortened or saved. The bridge part T2 is created according to musical properties of the two musical pieces A and B.

The medley C in this example is set as follows. First, the karaoke player enters the music code of the first musical piece A from the numeric key section 72 of the remote commander 7. Then, the player presses the input button 75 to confirm the music code of the piece A. This operation designates the music piece A to be played first. Then, upon pressing the medley input button 71, medley indication data MD is entered. The medley indication data MD specify a next musical piece entered after the pressing of the medley input button 71 as a second part of the medley. When the player enters the music code of the second piece B from the numeric key section 72 and confirms the music code of the piece B by pressing the input button 75, the musical piece B to be played second is designated.

To change the key (pitch), the player enters the music code of the piece A, conforms the entered code, then enters the key data of the piece A, further enters the music code of the piece B, and enters the key data of the piece B in this order. Thus, the key can be altered for each musical piece. The entered codes of the two musical pieces A and B constituting the medley C are fed to the CPU 1 along with the medley indication data MD and the key data KEY via the remote commander signal receiver 8.

Figure 4:
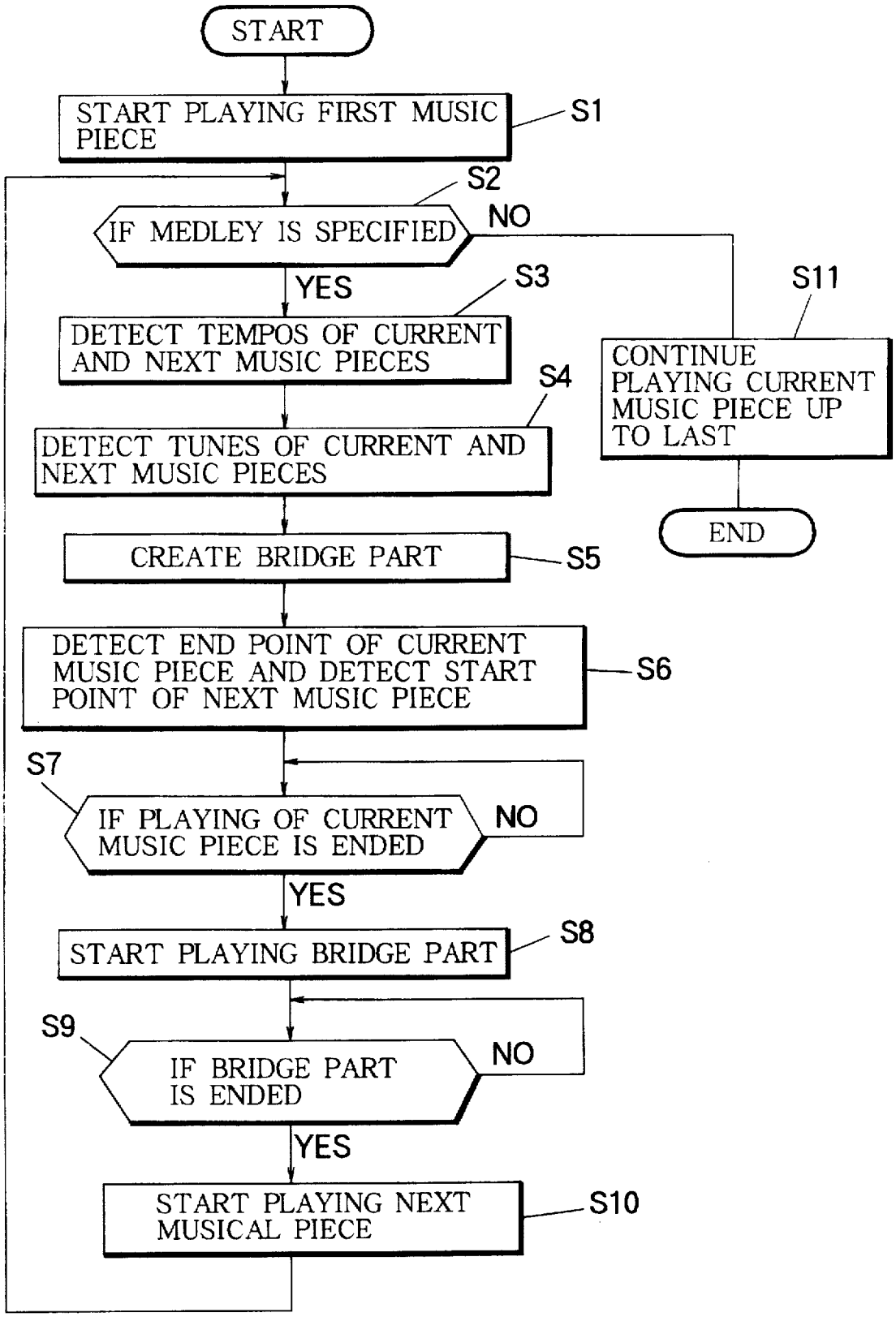
FIG. 4 is a flowchart showing operations of the karaoke apparatus of the embodiment of FIG. 1.

The following describes operations of the CPU 1 (which functionally constitutes a sequencer device and a medley editor device) to perform the medley upon reception of a transmission signal from the remote commander 7 with reference to the flowchart of FIG. 4. In the figure, the CPU 1 controls all components of the karaoke apparatus such that playing of the first musical piece A starts (step S1). The karaoke music data KD corresponding to the first musical piece A are transferred from the hard disk 6 to the RAM 2.

Based on the play data or performance KDe such as the note event data and the tone generator setting data included in the music data KD, a first sequence program is executed to set the timbre of the first tone generator in the tone generator device 15 and starts playing of the first music piece A. During playing of the introduction A1 of the first piece A, the CPU 1 controls the character generator 18 such that the music code and the title of the music piece A are displayed on the monitor 21.

Figure 5:
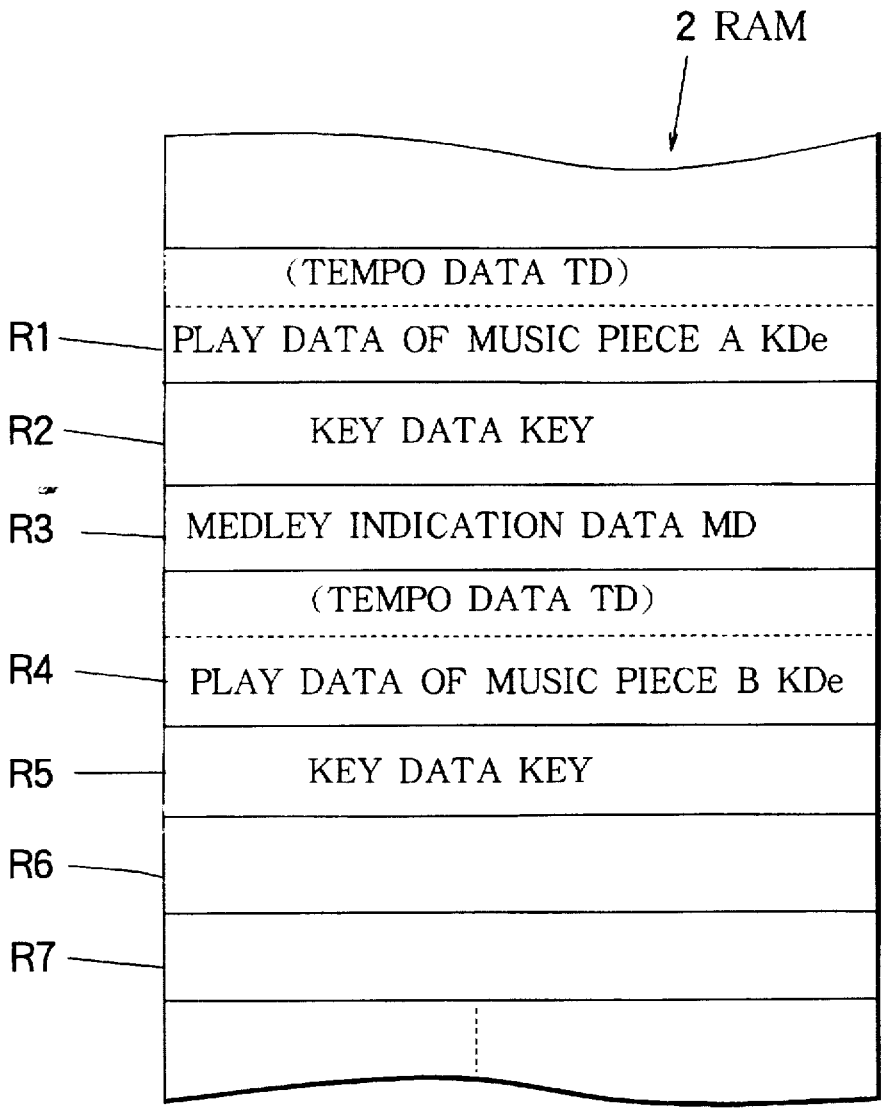
FIG. 5 is a diagram illustrating a structure of karaoke data stored in a RAM in the embodiment of FIG. 1.

As for the second musical piece B, the corresponding karaoke music data KD are transferred from the hard disk 6 to the RAM 2. The following describes a structure of the data stored in the RAM 2 when the aforementioned key change has been made, with reference to FIG. 5. In the figure, a storage area R1 is written with the play data of the first musical piece A. It should be noted that the play data KDe include tempo data TD that indicate a tempo of the musical piece A. A storage area R2 is written with the key data KEY that indicate the key alteration of the musical piece A. A storage area R3 is written with the medley indication data MD. A storage area R4 is written with the play data KDe of the second musical piece B. The play data KDe include tempo data TD that indicate a tempo of the musical piece B. A storage area R5 is written with the key data KEY that indicate the key alteration of the musical piece B. It should be noted that, in this example, the medley is formed from the first musical piece A and the second musical piece B, so that storage areas R6, R7 and so on are written with no data. However, if a third musical piece D for example is incorporated in the medley after the second musical piece B, the storage area R6 is written with the medley indication data MD, and the storage area R7 is written with play data KDe of the third musical piece D.

When playing of the first musical piece starts, the CPU 1 determines in step S2 whether the musical piece being played is specified or designated as a part of a medley. If Yes, the CPU 1 detects in step S3 the tempo of the currently played music piece and the tempo of the following music piece. In this example, because the medley of the musical piece A and the musical piece B is requested, the tempo of the currently played music piece and the tempo of the following music piece are detected. The tempo detection is performed by the CPU 1 by examining the tempo data TD in the play data KDe corresponding to the musical pieces A and B stored in the RAM 2.

Then, in step S4, tunes or tonalities of the currently played musical piece A and the next musical piece B are detected based on the play data KDe. The tune detection is performed based on chord progression detected by checking or examining a track of accompaniment sound by way of example. To be more specific, the tune detection is performed by finding a chord progression from chord (V) to chord (I), by detecting a frequence thereof, and by detecting chord progression from chord (V) through chord (I) to chord (IV). This chord detection is known and described in detail in Japanese Non-examined Patent Publication No. 2-83591 filed by the applicant hereof.

Next, in step S5, a bridge passage or bridge part is created. The bridge passage is formed based on the tempos of the musical pieces A and B detected in step S3 and the tunes of the musical pieces A and B detected in step S4.

In the bridge passage production, the CPU 1 compares the tune of the first musical piece A with the tune of the second musical piece B, and determines whether a difference between the tunes falls within an allowable range. If the difference is found within the predetermined allowable range, bridge performance data for playing the chord (V) of the tune corresponding to the second musical piece B is produced for one measure to create the bridge part. It should be noted that the predetermined range of the tune is set to a level at which the passage or transition to the second piece of music sounds natural when the chord (V) is played.

On the other hand, if the tune difference between the first musical piece A and the second musical piece B is found outside the predetermined range, intermediate bridge performance data are formed such as to indicate playing of the first musical piece A by modulating the tune thereof to a proximity tune of the second musical piece B for the first two beats of the bridge part and playing of the chord (V) of the tune corresponding to the second musical piece B for the third and fourth beats of the bridge part. The produced bridge part can agreeably connect the first musical piece A with the second musical piece B even if the difference in tune between the two musical pieces is remarkable.

Then, the tempo of the first musical piece A is compared with the tempo of the second musical piece B to determine whether the tempo difference falls within a negligible predetermined range. If the tempo difference is found within the predetermined range, intermediate bridge performance data are created such as to indicate playing of the second musical piece B at the same tempo as that of the first musical piece A. It should be noted that the predetermined range of tempo is set to a level at which the karaoke singer can sing agreeably when the bridge passage is played at the tempo of the preceding musical piece and then the succeeding musical piece is played.

On the other hand, if the tempo difference is found outside the predetermined range, bridge performance data are arranged such that the last note of the bridge passage is extended as a fermata. The produced bridge pattern can agreeably connect the first musical piece A with the second musical piece B in the transient period even if there is a noticeable difference in tempo between the two musical pieces. The intermediate performance data thus prepared for the bridge part are stored in the RAM 2.

When the operation in step S5 finishes, an end timing or point of the first musical piece A and a start timing or point of the second musical piece B are detected in step S6. The detection of these timings is performed as follows. First, for the respective one of the musical pieces A and B, a melody track is identified among the various tracks involved in the play data KDe. Generally, a melody is played only in a chorus interval and therefore not played in an introduction interval and an interlude interval. Consequently, the CPU 1 searches the melody track of the musical piece A for a point at which no note is found for a certain number of measures. The CPU 1 determines the searched end timing as a break point of the musical piece A, at which a change occurs from a sounding state in which a melody note is sounded to a silent state in which no melody note is sounded. Also, the CPU 1 searches the melody track of the musical piece B for a start point at which a note event occurs for the first time, and determines this point as the break point of the musical piece B.

When the end timing of the musical piece A and the start timing of the musical piece B have been thus detected, the CPU 1 determines in step S7 whether the end timing of the musical piece A has been reached or not. This determination is repeated until the end timing of the musical piece A is reached. Upon completion of the introduction A1 and the first chorus A2 of the musical piece A, the CPU 1 detects that the end timing has been reached. Then, playing of the bridge part T2 prepared in step S5 starts in step S8. By prefetching the play data KDe of the musical piece B according to a second sequence program during playing of the bridge part T2, the CPU 1 controls the character generator 18 such that the music code and the title of the musical piece B are displayed on the monitor 21. This allows the karaoke player to recognize the following second musical piece B in advance. In addition, in the above-mentioned timings, setting of the second tone generator in the tone generator device 15 is performed based on the setting data.

Then, the CPU 1 determines whether playing of the bridge part T2 has come to an end in step S9. This determination is repeated until the end of the bridge part playing is detected. When the bridge part T2 has been finished, the second sequence program is executed to start playing of the musical piece B from the first chorus B2 in step S10.

Lastly, the process goes back to step S2 to repeat the operations performed in steps S2 through S10. This example is associated with the medley C composed of the first musical piece A and the second musical piece B. Therefore, when the process goes back to step S2 upon starting of the playing of the second musical piece B (step S10), the decision in step S2 turns "NO" because no medley is specified after the musical piece B. In this case, the musical piece B being played is completed to the last end thereof in step S11.

Meanwhile, it is possible that the player may specify the third musical piece D after the second musical piece B in the medley before starting playing of the musical piece B. In this case, the tempo and the tune of the musical piece D are detected in steps S3 and S4 respectively to prepare another bridge passage based on the musical pieces B and D in step S5. Since the tempo and tune of the musical piece B are detected before to produce the bridge passage T2 between the musical pieces A and B, these already detected tempo and tune data are used as they are.

According to the present preferred embodiment, the karaoke player can designate any musical pieces that constitute a free medley. Further, since the bridge passage T2 is created based on musical property of the sequential musical pieces A and B in the medley, the karaoke player can sing without losing consistency in the transient period between the musical pieces. Still further, the compacted or mutilated chorus parts of the preceding musical piece and the succeeding musical piece can be connected with each other via the bridge passage T2, so that the number of musical pieces that can be sung in a relatively short time can be increased, satisfying karaoke singers' desire for singing as many songs as possible.

As described above, in the inventive medley playback apparatus, the storage device in the form of the HDD 6 stores a plurality of performance data KDe corresponding to a plurality of music pieces. The tone generator device 15 is fed with the performance data KDe to generate musical tones to thereby play back the corresponding music piece. The designator device such as the remote commander 7 designates at least a first music piece A and a second music piece B among the plurality of the stored music pieces. The editor device formed of the CPU 1 mutilates first performance data KDe corresponding to the first music piece A so as to produce a preceding compact part A1 and A2 thereof, also mutilates second performance data KDe corresponding to the second music piece B so as to produce a succeeding compact part B2, B3, B4 and B5 thereof, and creates intermediate performance data based on the first performance data and the second performance data so as to produce a bridge part T2 connecting between the preceding compact part A1 and A2 and the succeeding compact part B2–B5. The sequencer device also functionally formed of the CPU 1 sequentially feeds the tone generator device 15 with the mutilated first performance data, the intermediate performance data and the mutilated second performance data to thereby play back a desired medley C composed of a sequence of the preceding compact part A1 and A2, the bridge part T2 and the succeeding compact part B2–B5.

Specifically, the tone generator device 15 comprises a pair of tone generators which can generate musical tones independently from each other. The sequencer device feeds the mutilated first performance data to one of the tone generators and feeds the mutilated second performance data to the other of the tone generators while feeding the intermediate performance data to either of the tone generators. The editor device produces the bridge part T2 according to a musical property of the first music piece A and the second music piece B. The musical property includes at least one of a tempo, a tonality, a meter and a genre such that the bridge part T2 fits for musically connecting the first compact part A1 and A2 to the second compact part B2–B5. For example, the editor device produces the fitting bridge part T2 having a transitional tempo effective to adjust a difference of the tempo between the first compact part A1 and A2 and the second compact part B2–B5. Further, the editor device produces the fitting bridge part T2 having a transitional tonality effective to adjust a difference of the tonality between the first compact part A1 and A2 and the second compact part B2–B5. The editor device examines the first performance data and the second performance data to extract therefrom the musical property of the first music piece A and the second music piece B. The editor device divides the first performance data at a preceding break point to mutilate the first performance data and divides the second performance data at a succeeding break point to mutilate the second performance data. The sequencer device retrieves the mutilated first performance data before the preceding break point from the storage device to feed the tone generator device 15, then feeds the tone generator device 15 with the intermediate performance data, and thereafter retrieves the mutilated second performance data after the succeeding break point from the storage device to feed the tone generator device 15. The editor device analyzes the first performance data to set the preceding break point effective to separate the first compact part A1 and A2 from an ending part A5 of the first music piece A, and analyzes the second performance data to set the succeeding break point effective to separate the second compact part B2–B5 from an introductory part B1 of the second music piece B.

The present invention is not limited to the above-mentioned preferred embodiment. It should be understood that the following variations may be made by way of example.

(1) In the above-mentioned embodiment, the CPU 1 searches the guide melody track of the musical piece B to determine the break point at which a note occurs for the first time as the start timing of the musical piece B. It will be apparent that the CPU 1 may determine a start point before (by two bars for example) the point of time of the first note occurrence as the start timing of the musical piece B. In this variation, after ending of the bridge passage T2, the introduction B1 of the following musical piece B is played a little before starting of the first chorus B2, making it easier for the karaoke singer to sing.

(2) In the above-mentioned embodiment, the break point is determined based on the note event data of the track corresponding to the melody. It will be apparent that break point data indicating the start and end of each part of the medley may be written to the play data KDe beforehand and the written break point data may be detected to determine the start timing and end timing of each part of the medley.

(3) In the above-mentioned embodiment, the bridge part is produced based on the tempos and tunes of the preceding and succeeding musical pieces in the medley. It will be apparent that a table of bridge performance data including beats or meter and genre of the preceding and succeeding musical pieces may be stored in the ROM or the like beforehand and the stored table may be searched for generating the bridge passage. Also, the bridge performance data may be a sequence of note event data that indicate notes to be generated. In this case, the tone generator setting data for the bridge passage is adopted from the musical piece A.

(4) In the above-mentioned embodiment, the last musical piece of the medley must be entered before playing the immediately preceding musical piece. This is because the time of the processing in the steps S2 through S6 of FIG. 4 is taken into consideration. Therefore, it will be apparent that, if a CPU or the like capable of high-speed processing is used, the last musical piece may also be entered after starting the immediately preceding musical piece. Namely, the processing time long enough for generating the bridge performance data may only be required. It will be also apparent that the tune data and the chord progression data (a chord sequence) may be arranged on a separate track to eliminate the necessity for such processing as tune detection.

(5) In the above-mentioned embodiment, the tone generator device 15 has the first and second tone generators which are used alternately for the medley playing. This is because it takes time to create the bridge passage. Therefore, it will be apparent that, if the processing time is relatively short, the medley may be played with a single tone generator.

As described above, according to the invention, musical pieces that constitute a medley can be selected in free manner, thereby allowing a karaoke singer to place any of his or her favorite songs in the medley for more singing satisfaction. In addition, the fitting bridge passage is provided between the preceding and succeeding musical pieces in the medley based on musical property of these musical pieces, thereby allowing the karaoke singer to sing without losing consistency between the musical pieces.

While the invention has been particularly shown and described with reference to the preferred embodiment thereof, it will be understood by those skilled in the art that the foregoing and other changes in form and details can be made therein without departing from the spirit and scope of the invention.

What is claimed is:

1. A medley playback apparatus comprising:

a storage device that stores a plurality of performance data corresponding to a plurality of music pieces;

a generator device that is fed with the performance data to generate musical tones to thereby play back the corresponding music piece;

a designator device that designates at least a first music piece and a second music piece among the plurality of the stored music pieces;

an editor device that mutilates first performance data corresponding to the first music piece so as to produce a preceding compact part thereof, that also mutilates second performance data corresponding to the second music piece so as to produce a succeeding compact part thereof, and that creates intermediate performance data based on the first performance data and the second performance data so as to produce a bridge part connecting between the preceding compact part and the succeeding compact part; and a sequencer device that sequentially feeds the generator device with the mutilated first performance data, the intermediate performance data and the mutilated second performance data to thereby play back a desired medley composed of a sequence of the preceding compact part, the bridge part and the succeeding compact part.

2. A medley playback apparatus according to claim 1, wherein the generator device comprises a pair of tone generators which can generate musical tones independently from each other, and wherein the sequencer device feeds the mutilated first performance data to one of the tone generators and feeds the mutilated second performance data to the other of the tone generators while feeding the intermediate performance data to either of the tone generators.

3. A medley playback apparatus according to claim 1, wherein the editor device produces the bridge part according to a musical property of the first music piece and the second music piece, the musical property including at least one of a tempo, a tonality, a meter and a genre such that the bridge part fits for musically connecting the first compact part to the second compact part.

4. A medley playback apparatus according to claim 3, wherein the editor device produces the fitting bridge part having a transitional tempo effective to adjust a difference of the tempo between the first compact part and the second compact part.

5. A medley playback apparatus according to claim 3, wherein the editor device produces the fitting bridge part having a transitional tonality effective to adjust a difference of the tonality between the first compact part and the second compact part.

6. A medley playback apparatus according to claim 3, wherein the editor device examines the first performance data and the second performance data to extract therefrom the musical property of the first music piece and the second music piece.

7. A medley playback apparatus according to claim 1, wherein the editor device divides the first performance data at a preceding break point to mutilate the first performance data and divides the second performance data at a succeeding break point to mutilate the second performance data, and wherein the sequencer device retrieves the mutilated first performance data before the preceding break point from the storage device to feed the generator device, then feeds the generator device with the intermediate performance data, and thereafter retrieves the mutilated second performance data after the succeeding break point from the storage device to feed the generator device.

8. A medley playback apparatus according to claim 7, wherein the editor device analyzes the first performance data to set the preceding break point effective to separate the first compact part from an ending part of the first music piece, and analyzes the second performance data to set the succeeding break point effective to separate the second compact part from an introductory part of the second music piece.

9. A method of playing back a medley in a medley playback apparatus comprised of a storage device that stores a plurality of performance data corresponding to a plurality of music pieces, and a generator device that is fed with the performance data to generate musical tones to thereby play back the corresponding music piece, the method comprising the steps of:

designating at least a first music piece and a second music piece among the plurality of the stored music pieces;

mutilating first performance data corresponding to the first music piece so as to produce a preceding compact part thereof;

mutilating second performance data corresponding to the second music piece so as to produce a succeeding compact part thereof;

creating intermediate performance data based on the first performance data and the second performance data so as to produce a bridge part connecting between the preceding compact part and the succeeding compact part; and sequentially feeding the generator device with the mutilated first performance data, the intermediate performance data and the mutilated second performance data to thereby play back a desired medley composed of a sequence of the preceding compact part, the bridge part and the succeeding compact part.

10. The method according to claim 9, further comprising the step of providing the generator device in the form of a pair of tone generators which can generate musical tones independently from each other, and wherein the step of sequentially feeding comprises feeding the mutilated first performance data to one of the tone generators and feeding the mutilated second performance data to the other of the tone generators while feeding the intermediate performance data to either of the tone generators.

11. The method according to claim 9, wherein the step of creating comprises producing the bridge part according to a musical property of the first music piece and the second music piece, the musical property including at least one of a tempo, a tonality, a meter and a genre such that the bridge part fits for musically connecting the first compact part to the second compact part.

12. The method according to claim 11, wherein the step of producing comprises producing the fitting bridge part having a transitional tempo effective to adjust a difference of the tempo between the first compact part and the second compact part.

13. The method according to claim 11, wherein the step of producing comprises producing the fitting bridge part having a transitional tonality effective to adjust a difference of the tonality between the first compact part and the second compact part.

14. The method according to claim 11, wherein the step of producing includes analyzing the first performance data and the second performance data to extract therefrom the musical property of the first music piece and the second music piece.

15. The method according to claim 9, wherein the step of mutilating first performance data comprises dividing the first performance data at a preceding break point to mutilate the first performance data, the step of mutilating second performance data comprises dividing the second performance data at a succeeding break point to mutilate the second performance data, and the step of sequentially feeding comprises retrieving the mutilated first performance data before the preceding break point from the storage device to feed the generator device, then feeding the generator device with the intermediate performance data, and thereafter retrieving the mutilated second performance data after the succeeding break point from the storage device to feed the generator device.

16. The method according to claim 15, wherein the step of dividing the first performance data comprises analyzing the first performance data to set the preceding break point effective to separate the first compact part from an ending part of the first music piece, and the step of dividing the second performance data comprises analyzing the second performance data to set the succeeding break point effective to separate the second compact part from an introductory part of the second music piece.

* * * * *